US009435149B1

(12) United States Patent
Glickman et al.

(10) Patent No.: US 9,435,149 B1
(45) Date of Patent: Sep. 6, 2016

(54) VENT STOP FOR WINDOW SASHES

(71) Applicants: Joel I. Glickman, Jupiter, FL (US); Charles Rodgers, Langhorne, PA (US)

(72) Inventors: Joel I. Glickman, Jupiter, FL (US); Charles Rodgers, Langhorne, PA (US)

(73) Assignee: Rodon Limited Partnership, Hatfield, PA (US)

( * ) Notice: Subject to any disclaimer, the term of this patent is extended or adjusted under 35 U.S.C. 154(b) by 433 days.

(21) Appl. No.: 14/040,090

(22) Filed: Sep. 27, 2013

(51) Int. Cl.
*E05C 17/50* (2006.01)

(52) U.S. Cl.
CPC ..... *E05C 17/50* (2013.01); *Y10T 292/0848* (2015.04); *Y10T 292/0953* (2015.04)

(58) Field of Classification Search
CPC ..... E05C 17/50; E05C 17/46; E05C 17/44; E05C 17/443; Y10T 292/0953; Y10T 292/0848; Y10T 292/0854; Y10T 292/0857
See application file for complete search history.

(56) References Cited

U.S. PATENT DOCUMENTS

| | | | | |
|---|---|---|---|---|
| 4,824,154 | A | 4/1989 | Simpson | |
| 4,923,230 | A | 5/1990 | Simpson | |
| 5,248,174 | A | 9/1993 | Matz et al. | |
| 5,536,052 | A * | 7/1996 | Maier | E05B 65/08 292/338 |
| 5,575,116 | A * | 11/1996 | Carlson | E05B 65/0852 49/417 |
| 5,806,900 | A * | 9/1998 | Bratcher | E05B 65/0864 292/137 |
| 6,364,375 | B1 | 4/2002 | Szapucki et al. | |
| 6,572,158 | B2 | 6/2003 | Szapucki et al. | |
| 7,530,611 | B2 | 5/2009 | Liang et al. | |
| 7,588,271 | B1 * | 9/2009 | Lawrence | E05B 65/0852 292/240 |
| 7,600,796 | B2 * | 10/2009 | Liang | E05C 17/50 292/207 |
| 7,637,544 | B2 * | 12/2009 | Liang | E05C 17/50 292/338 |
| 8,235,430 | B2 | 8/2012 | Liang et al. | |
| 8,360,484 | B2 * | 1/2013 | Liang | E05B 65/0847 292/220 |
| 8,806,809 | B1 * | 8/2014 | Lawrence | E05D 13/06 292/338 |
| 2009/0206616 | A1 * | 8/2009 | Liang | E05C 17/60 292/338 |
| 2010/0281780 | A1 * | 11/2010 | Liang | E06B 7/28 49/449 |
| 2012/0144758 | A1 * | 6/2012 | Koch | E04H 3/123 52/10 |
| 2012/0167475 | A1 * | 7/2012 | Sopkowiak | E05B 65/0835 49/449 |

OTHER PUBLICATIONS

Anderson Windows Parts—Double-Hung Window Opening Control Device; Retrieved via Internet on Sep. 11, 2013; URL http://parts.andersonwindows.com/detail_9021976_w_dh_ww_safety.html; 1 page.

(Continued)

*Primary Examiner* — Daniel Rohrhoff
(74) *Attorney, Agent, or Firm* — St. Onge Steward Johnston & Reens LLC

(57) ABSTRACT

A fully functioning, pivoting vent stop for sliding windows has only two parts, a housing and a pivoting tumbler, both formed of injection molded plastic material. The tumbler is pivotally mounted in the housing and has integral detent elements cooperating with detent elements on the housing walls to position the tumbler in recessed or extended limit positions. The cooperating detent elements also provide an over-centering spring action as the tumbler is actuated between its limit positions. Assembly of the two-part device is achieved in a highly simplified and economical manner by configuring an internal cavity in the housing with inclined slots in the internal side walls of the housing. This enables the tumbler to be resiliently pressed into the cavity, temporarily displacing the housing side walls outwardly, until the cooperating pivot and detent elements are fully engaged.

26 Claims, 7 Drawing Sheets

(56) References Cited

OTHER PUBLICATIONS

Ashland Online Catalog—SightLine Vent Lock With Universal Attachment; Retrieved via Internet on Sep. 10, 2013; URL http://www.ashlandhardware.com/ashland-product-catalog/; 1 page.

Ashland Online Catalog—SightLine Vent Stops With Universal Attachment; Retrieved via Internet on Sep. 10, 2013; URL http://www.ashlandhardware.com/ashland-product-catalog/; 1 page.

Ashland Online Catalog—SightLine Window Opening Control Device; Retrieved via Internet on Sep. 10, 2013; URL http://www.ashlandhardware.com/ashland-product-catalog/; 1 page.

* cited by examiner

VENT STOP FOR WINDOW SASHES

FIELD OF THE INVENTION

The present invention relates to window opening control devices, often referred to as vent stops, which can be actuated to limit the extent to which a window sash may be opened. This enables the sash to be opened enough for ventilation while limiting the opening to a desired maximum size. More particularly, the invention relates to vent stops incorporating a pivoting stop element.

BACKGROUND OF THE INVENTION

Pivoting vent stops are in general well known devices that are designed to be mounted on sash rails of double hung windows or other slidable window arrangements in a position to allow a window sash to be opened to, but not beyond, a predetermined position. A typical pivoting vent stop includes a housing arranged to be mounted in a sash frame, a tumbler pivotally mounted in the housing and movable between retracted and extended positions, a spring for biasing the tumbler toward its extended position, and some form of retention means for retaining the tumbler in a retracted position. When the tumbler is retracted, a window sash may slide over the housing and thus be moved to fully open position. When the tumbler is in an extended position, however, it engages the sash after partial opening thereof and blocks further opening movement. When it is necessary or desirable to fully open the sash, the tumbler is pushed back into its housing and held in a retracted position until needed.

An early form of pivoting vent stop is reflected in the Szapucki et al U.S. Pat. No. 6,572,158, which incorporates a pivoted tumbler biased toward an extended position by a spring. In order to retain the tumbler in a retracted position, when desired, the tumbler can be pressed inward and then slid on a loose pivot connection until an end portion of the tumbler lies underneath a lip on the housing. The tumbler is released, when desired, by sliding the tumbler in an opposite direction to free the end portion and allow the tumbler to be pivoted outward by the biasing spring. A shortcoming of this type of device is the inconvenience of manipulating the tumbler for locking and unlocking it in or releasing it from a retracted position.

A different form of pivoting vent stop is represented by the Liang et al U.S. Pat. Nos. 7,600,796 and 7,637,544. In each of these devices, a tumbler is pivotally mounted in a housing and biased to a projected position by a spring. A separate, spring-biased latch mechanism is contained within the housing to engage the tumbler, when retracted, and retain it in a retracted position until the user desires to release it into an extended or locking position. A push-button type of release is provided for the latch mechanisms, such that the tumbler can be retracted by pressing on the projected end of the tumbler, and released by pressing on the push button release for the latching mechanism. A shortcoming of these designs is their relative complexity and corresponding higher cost, as well as a somewhat larger physical size to accommodate the presence of the release mechanism.

Yet another form of pivoting vent stop is represented by the Liang et al U.S. Pat. Nos. 7,530,611 and 8,235,430. Each of these devices utilizes a special spring element which is attached to a pivoted tumbler and has a horizontally extending portion that slides over a contoured bottom of the housing in which the tumbler is mounted. The combination of the sliding spring and the contoured housing bottom is intended to cause the tumbler to be self-retaining in retracted or extended positions without the need for special locking and/or releasing mechanisms. This arrangement, while having certain desirable functional features has the shortcoming of requiring extra parts and the assembly operations associated therewith, which adds extra cost to a highly cost-sensitive product.

There remains a need for a pivoted vent stop that is fully functional but which nevertheless requires an absolute minimum of parts, resulting in lower manufacturing and assembly costs.

SUMMARY OF THE INVENTION

The present invention is directed to an advantageous form of pivoting vent stop which is comprised of only two parts: a housing, and a tumbler pivotally mounted within the housing. The two parts are formed of injection molded plastic material and thus suitable for production on an economical basis. The vent stop of the invention incorporates a novel construction by which the two parts thereof cooperate to provide an integrally formed resilient detent arrangement whereby the tumbler is self-retaining in either of its retracted or extended positions. The design and structure of the new device is such that the two parts thereof, after molding, may be assembled by simply pressing the tumbler part into the housing part, whereupon the tumbler is pivotally mounted within the housing and the detent features are automatically functional.

As a feature of the invention, portions of the housing and portions of the tumbler cooperate resiliently to form a two-position detent, allowing the tumbler to be manually pivoted between its retracted and extended positions and automatically retained in either of those positions. This desirable function is achieved in the device of the invention without the use of added spring elements that are found in prior art devices and which add significantly to the cost of production.

In a particularly preferred form of the invention, the desired resilient detent action is derived from the side walls of the housing, which are formed of a plastic material having suitable strength and resilience. The housing side walls are formed with detent recesses therein which receive detent projections extending laterally from the tumbler and spaced radially from the pivot axis of the tumbler. The detent recesses are disposed along an arcuate path followed by the detent projections during pivoting movements of the tumbler. The recesses are formed with end portions, corresponding to recessed and extended limit positions of the tumbler, and with a restricted intermediate portion. When the tumbler is pivoted from one limit position to the other, the detent projections pass through the restricted intermediate portion of the detent recess and resiliently displace such restricted portions in order to pass through. A modest degree of force is required to cause the detent projections to pass through the restricted portion, and the tumbler is thus automatically retained in either of its limit positions until intentionally moved by pressing on one end or the other of the tumbler.

To particular advantage, the detent recesses comprise primary openings through the opposed side walls of housing, and secondary openings on at least one side, and preferably both sides of the primary openings. The secondary openings, together with the primary openings, define resiliently displaceable side wall portions that are deflected within the planes of the respective side walls, to allow passage of the detent projections through the restricted portions of the detent openings.

For a more complete understanding of the above and other features and advantages of the invention, reference should be made to the following detailed description of a preferred embodiment of the invention, and also to the accompanying drawings.

DETAILED DESCRIPTION OF THE INVENTION

Figure 1:
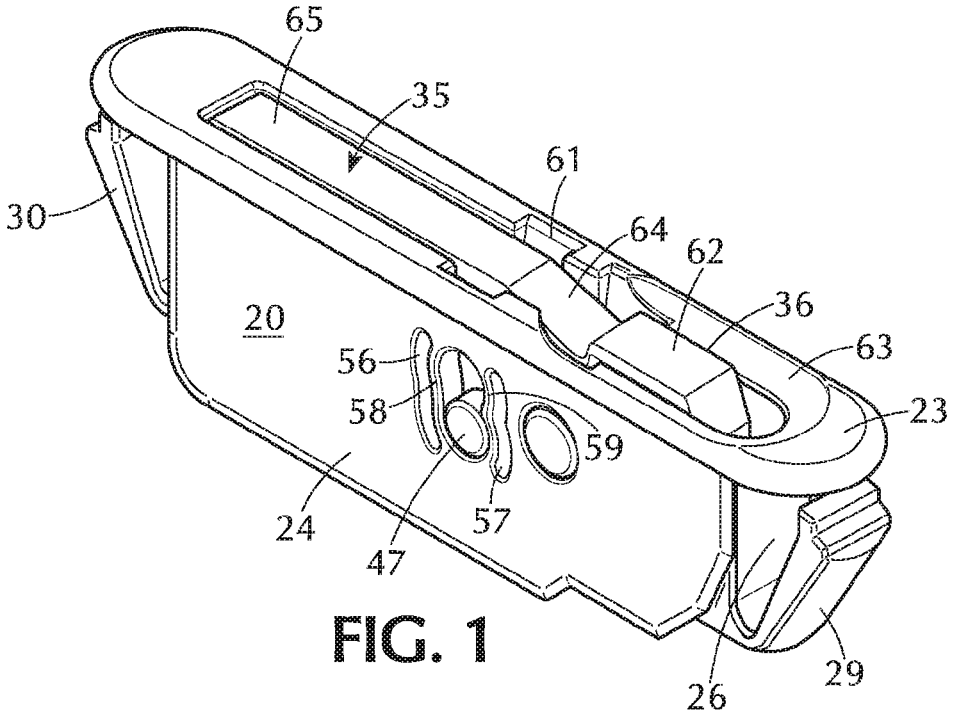
FIG. 1 is orthographic view of a vent stop mechanism according to the invention, shown with the tumbler in a retracted position.

Referring to the drawings, the numeral 20 designates generally a housing part of the two-part vent stop device of the invention. The housing forms an upwardly opening cavity 21 which receives a tumbler 22. It will be understood that, throughout this specification, directional terms such as "upward", "downward", "laterally" and the like are referenced to the representational orientation of the device as shown in the drawings, and are used for convenience only and not in a limiting manner. In actual practice, the vent stop may be used in any orientation called for by its mounting in a window sash.

In the illustrated and preferred form of the device, the housing 20 is formed with a top plate or flange 23, which surrounds and extends outward from upper edges of the sidewalls 24, 25 and end walls 26, 27 of the housing. The housing also includes a bottom wall 28. Integral mounting clips 29, 30 are provided at each end of the housing 20, extending outward and upward from bottom portions of the respective end walls 26, 27. Upper portions of the mounting clips 29, 30 underlie opposite end extremities of the flange 23, as shown in, for example, FIG. 7. The lower portions of the mounting clips extend integrally from lower portions of the housing end walls and are designed to flex inwardly toward the end walls. The housing 20 is intended to be mounted in a hollow sash frame or stile (not shown), which is provided with an opening (not shown) closely fitting the side walls 24, 25 of the housing 20 and extending somewhat beyond the end walls 26, 27, although not as far as the end extremities of the flange 23. When the housing is pressed into the sash opening, upper portions of the mounting clips 29, 30 initially flex inwardly, toward the housing end walls, allowing the tops of the clips to pass through the opening. Once through the opening, the clips flex outwardly to underlie or partly underlie the outer wall of the sash, depending upon the thickness of the outer wall. The housing is thus locked in place, with the flange 23 snuggly seated on the outer surface of the sash wall. The described manner of mounting the housing is well known and well understood by those skilled in the art.

In accordance with aspects of the invention, the housing side walls 24, 25 are provided with axially, aligned circular through openings 31, 32 for the pivotal mounting of the tumbler 22. The tumbler, which is injection molded of plastic material, is formed with integrally molded cylindrical pivot pins 33, 34, which are received in the respective pivot openings 31, 32 and provide for pivotal mounting of the tumbler in the housing about a predetermined pivot axis.

Figure 2:
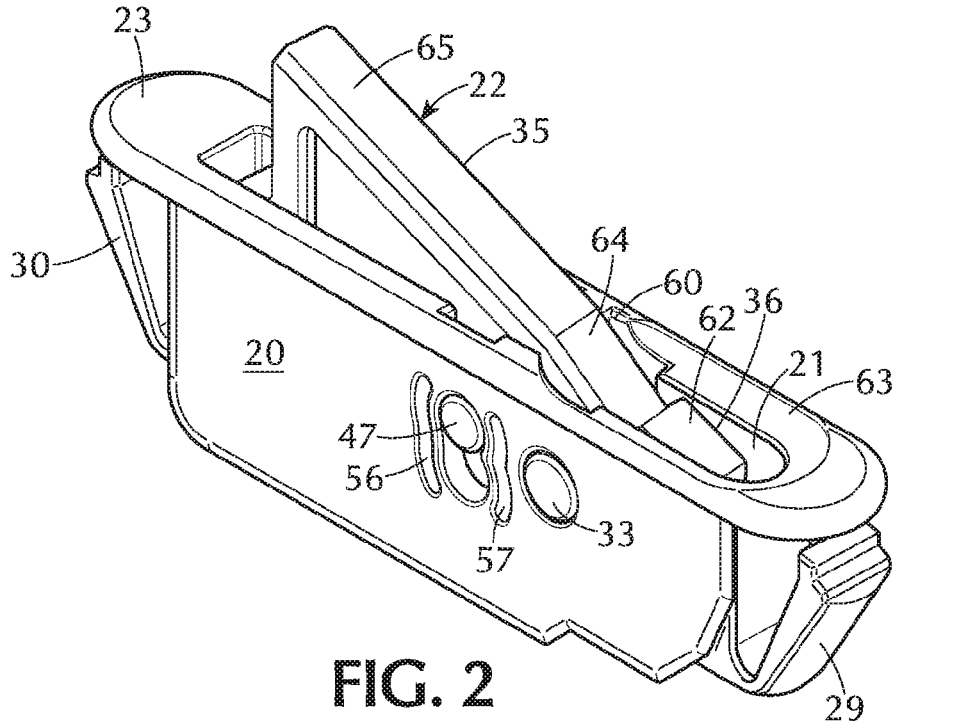
FIG. 2 is an orthographic view, similar to FIG. 1, showing the tumbler in a projected or extended position.
Figure 3:
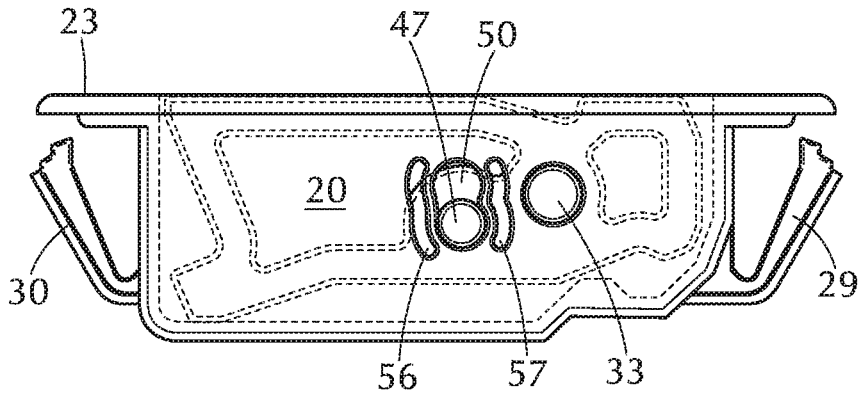
FIG. 3 is a side elevational view of the mechanism of FIG. 1, with the tumbler in a retracted position.
Figure 4:
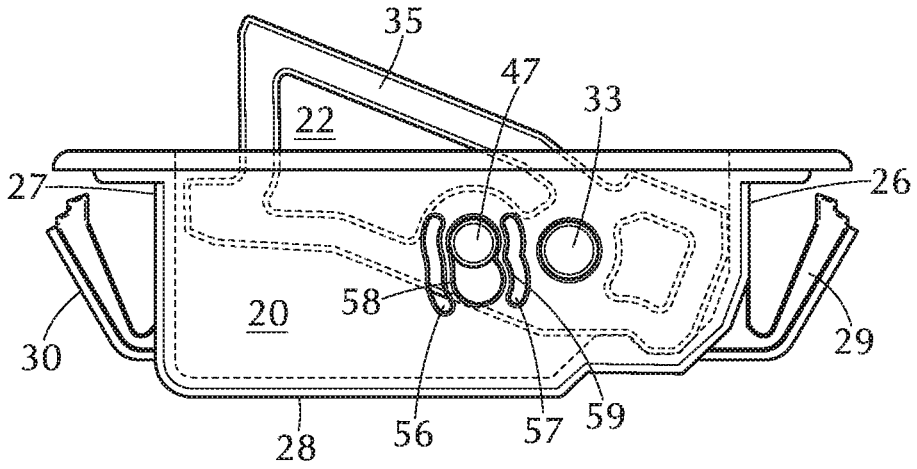
FIG. 4 is a side elevational view similar to FIG. 3, showing the tumbler in an extended position.
Figure 5:
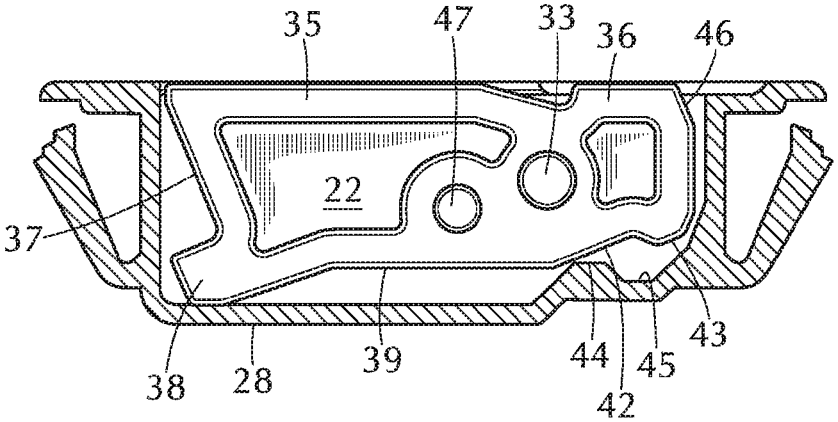
FIGS. 5 and 6 are longitudinal cross-sectional views, corresponding to FIGS. 3 and 4, showing the tumbler in retracted and extended positions, respectively.
Figure 6:
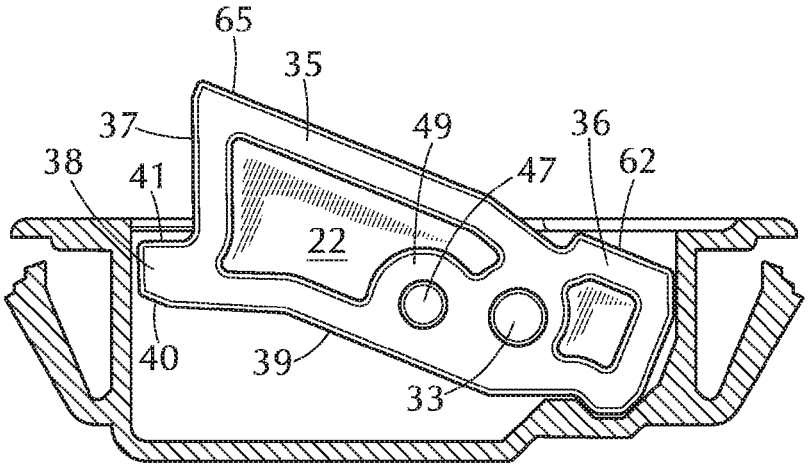

As shown particularly in FIGS. 1-6, the tumbler 22 has two limit positions in the housing 20, a fully retracted position, shown in FIGS. 1, 3 and 5, and an extended position, shown in FIGS. 2, 4 and 6. As indicated in the drawings, the pivot axis of the tumbler is asymmetrically positioned, such that one end 35 of the tumbler (the left end as viewed in FIGS. 1-6) is of considerably greater length than the other end 36. When the tumbler is pivoted to its retracted limit position, the upper surfaces of both end portions 35 and 36 of the tumbler are substantially flush with the upper surfaces of the flange 23, allowing a window sash to slide freely over the top of the flange and the retracted tumbler. In the extended limit position of the tumbler, the end portion 35 thereof is projected outward from the flange 23 and presents an abutment surface 37 thereof generally at right angles to the sash frame in which the device is mounted. The abutment surface is positioned to engage the upper or lower sash frame member (in a typical, vertically sliding window) to limit the extent to which the sash may be opened. The vent stop device typically is positioned in such manner as to limit opening movement of a window sash to a desired maximum, typically about 4 inches In the illustrated form of the invention, the retracted limit position of the tumbler 22 is determined in part by means of an extension 38 of the bottom 39 of the tumbler. As shown in FIG. 5, the extension 38 has a bottom surface 40 that engages the bottom wall 28 to limit pivotal retracting movement of the tumbler. Once in the retracted position, the tumbler is held in that position by a unique detent means to be described. The extension 38 extends a short distance beyond the abutment surface 37 and provides an outer surface 41 that can function as a secondary stop feature. If forces greater than normal were to be applied to a sash in an opening direction, the extension surface 41 will engage the face of the sash and assist in maintaining its position.

As shown particularly in FIG. 6, the short end 36 of the tumbler, which is recessed when the tumbler is in its extended limit position, has downwardly facing surfaces 42, 43, which engage with upwardly facing surfaces 44, 45 of the housing bottom wall to form a strong positive limit stop to pivoting movement of the tumbler in the extending direction. This is arranged to strongly resist pivoting movement of the tumbler in response to sash pressure on the abutment surface 37. Additionally, the recessed end 36 of the tumbler, when the tumbler is in its extended position, has a surface portion 46 which bears against the inner surface of the end wall 26. This serves to transmit longitudinally directed forces, applied against the tumbler via the abutment surface 37, into the housing end wall, partially isolating such forces from the pivot pins 33, 34 and the respective pivot openings 31, 32 in the housing side walls. The housing 20, being supported by the wall of sash frame, can readily withstand the forces transmitted thereto by the surface portion 46 of the tumbler.

In accordance with an important aspect of the invention, the tumbler 22 and housing 20 are provided with novel, self-contained detent features providing a desired over-centering spring action and serving to retain the tumbler 22 is its respective retracted or extended positions without requiring additional springs or other parts that would add cost and complexity of the device. To this end, the tumbler 22 is provided on opposite sides with detent projections 47, 48 which are spaced a short distance from the pivot axis formed by the pivot pins 33, 34. In a representative but non-limiting example, in which a tumbler of approximately 1.4 inches in length is configured to pivot through an angle of about 22.5°, the detent projections may be spaced from the pivot axis a distance of approximately 0.250 inch. The detent projections, which conveniently but not necessarily are of cylindrical form, have a diameter of about 0.125 inch, extend a short distance (e.g., 0.057 inch) outward from the side walls 49 of the tumbler and project through detent openings 50 in the opposite side walls 24, 25 of the housing. In the described but non-limiting example, the side walls of the housing may have a typical thickness of about 0.059 inch, it being understood that such side walls will have a small taper (e.g., 1°) to accommodate the molding processes.

Figure 7:
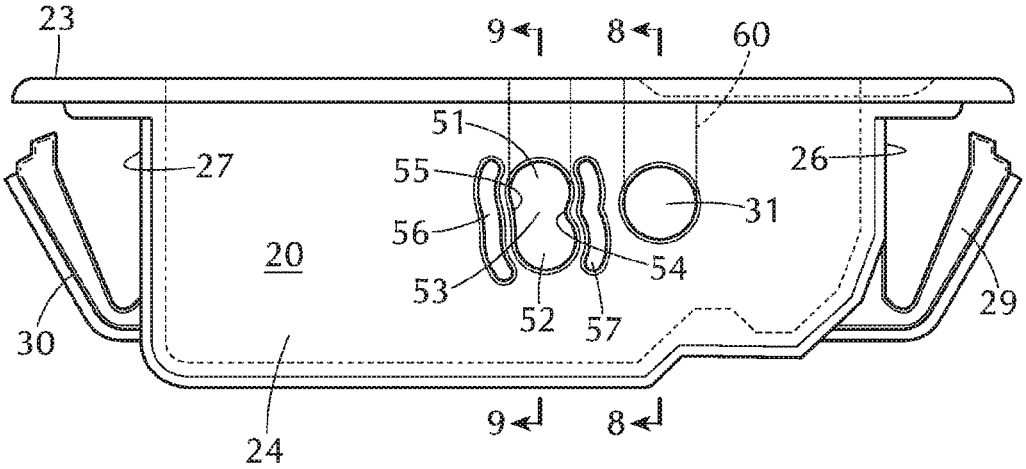
FIG. 7 is a side elevational view of the housing without a tumbler installed therein.

As illustrated particularly in FIG. 7, the detent opening is formed with upper and lower end portions 51, 52 of a size and shape to receive the detent projections 47, 48 in the respective limit positions of the tumbler. To advantage, the end portions are of circular form, of just slightly larger diameter than the diameter of the detent projections. The positioning of the detent recesses is such, in relation to the diameter of the detent projections, that the circular end portions 51, 52 slightly overlap to form partially restricted intermediate portion 53*s*. For example, circular end portions 51, 52 of 0.127 inch in diameter may be spaced apart a distance of 0.097 inch, such that the end portions overlap about 0.030 forming openings 50 having somewhat of a figure eight configuration. In the illustrated embodiment, the central side edge portions 54 of the opening closest to the pivot axis are rounded slightly, and the opposite central side edge portions 55 are rounded to a somewhat greater degree, such that the figure eight configuration is slightly asymmetrical, as illustrated in the drawings, but with a width dimension in the restricted intermediate portions 53 of slightly less than the diameter of the detent projections 47, 48. As a non-limiting example, the width dimension of the restricted portions 53 may be about 0.110 inch in conjunction with detent projections of 0.150 inch diameter. The arrangement is such that, when the tumbler 22 is pivoted between its limit positions, the projections must be forced through the restricted portions 53. In addition, once passed through the restricted portions, the detent projections are resiliently urged into their new limit positions with somewhat of a snap action and retained in their new positions, such that the tumbler 22 is always snuggly retained on one or the other of its two limit positions.

In accordance with a feature of the invention, secondary openings 56, 57 are formed in one or both of the housing side walls 24, 25, spaced closely adjacent to the opposite sides of the detent openings 50 therein. The respective secondary openings 56, 57 preferably are contoured to follow the side edge contours of the detent openings 50 and extend substantially from the top to the bottom of the detent openings. In the illustrated embodiment, the secondary openings extend to points slightly above and slightly below the top and bottom extremities of the detent openings 50. The detent openings 50 and their respective secondary openings 56, 57 define between them resiliently displaceable side wall portions 58, 59 which, at their upper and lower ends, are integral with the housing side walls 24, 25 while being resiliently displaceable in their mid portions to accommodate passage of the detent projections 47, 48 through the restricted mid portions 53 of the detent openings. In an exemplary but non-limiting example, the displaceable side wall portions may have a width of about 0.030 inch from top to bottom. Persons skilled in the art will, however, be aware that the width dimension of the detent openings 50 in their restricted portions 53 and the width dimensions of the displaceable side wall portions 58, 59 may be somewhat variable depending on the desired level of force required to pivot the tumbler from one limit position to the other. The functional principles of operation will remain the same, regardless of such dimensional variations.

Figure 8:
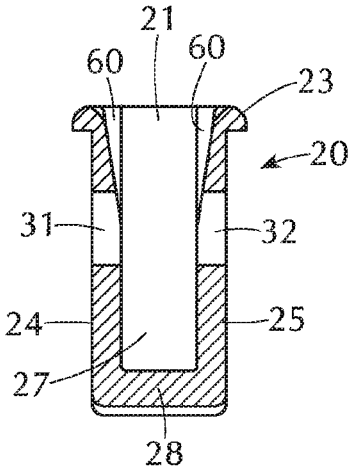
FIGS. 8 and 9 are cross-sectional views as taken generally along lines 8-8 and 9-9, respectively, of FIG. 7.
Figure 9:
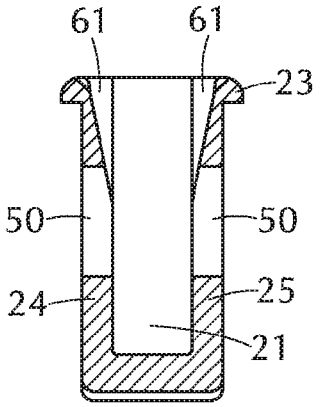
Figure 10:
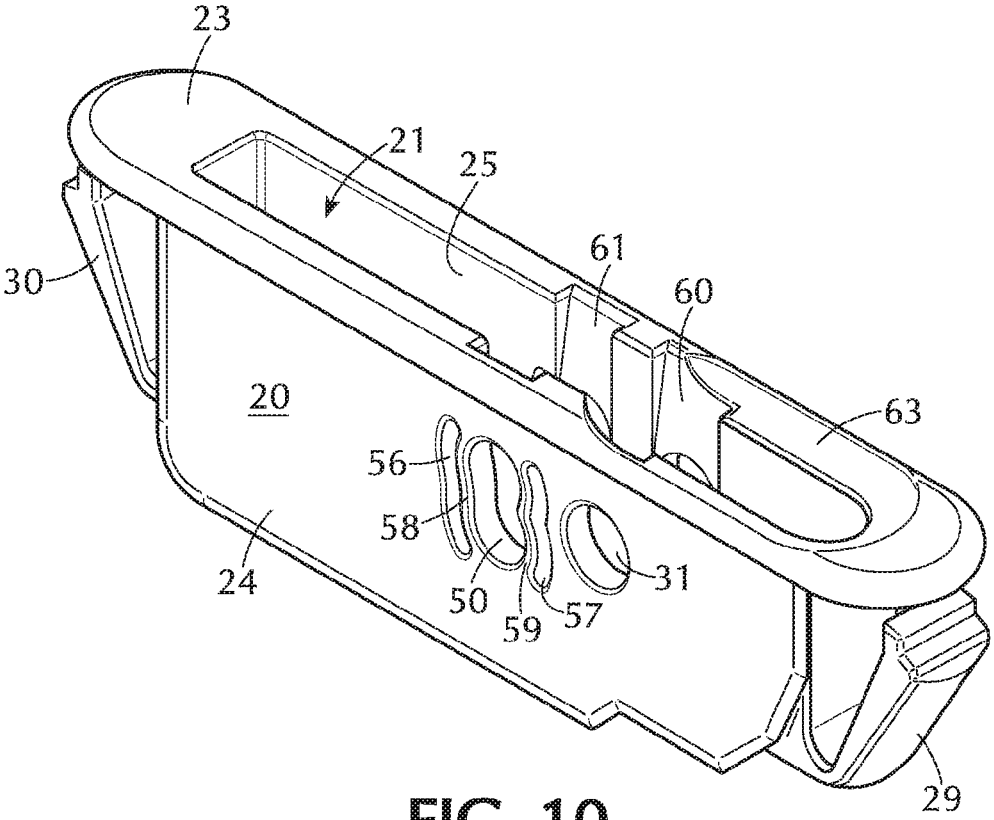
FIG. 10 is in orthographic view of the housing part without a tumbler installed therein.
Figure 11:
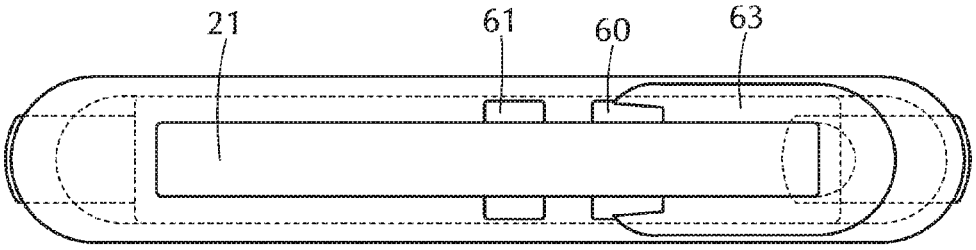
FIG. 11 is a top plan view of the housing part.
Figure 12:
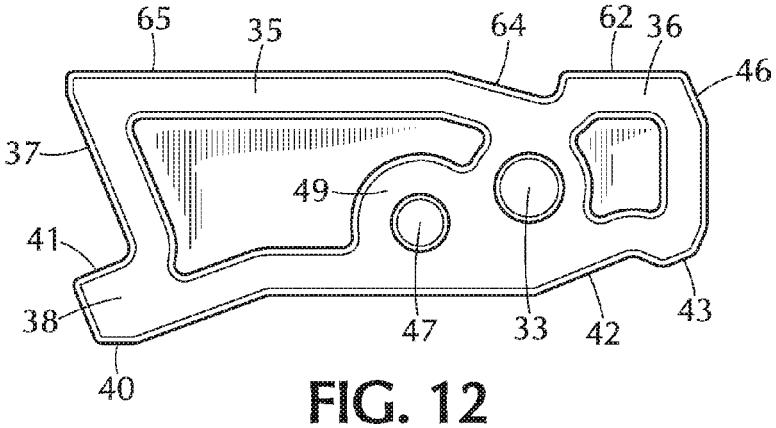
FIGS. 12 and 13 are side elevational and bottom plan views, respectively, of the tumbler part by itself.
Figure 13:
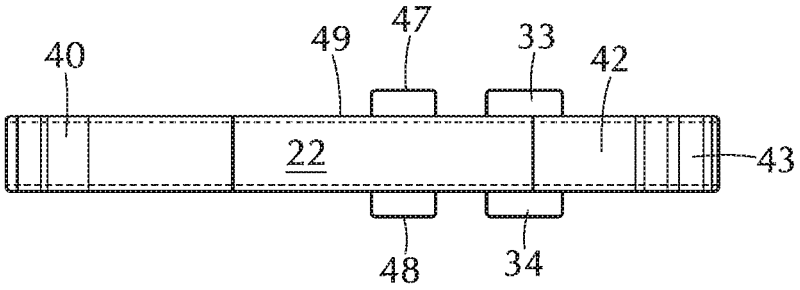
Figure 14:
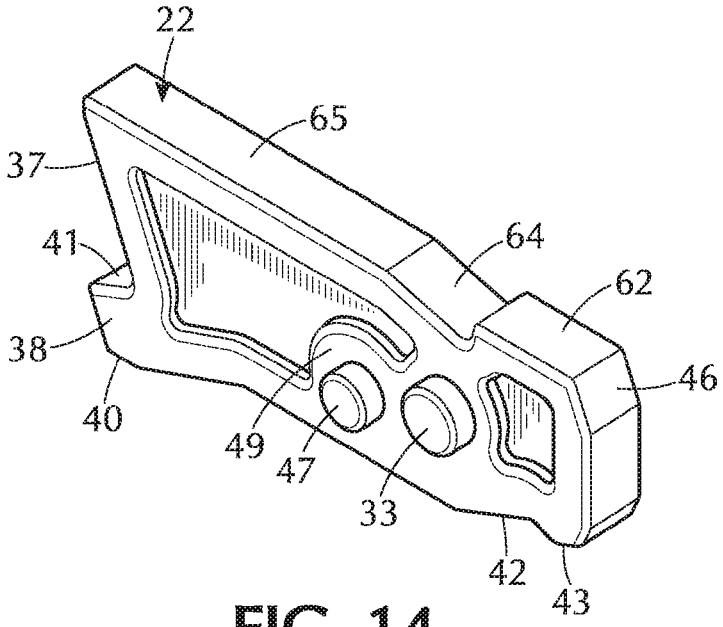
FIG. 14 is an orthographic view of the tumbler part of FIGS. 12 and 13.

To facilitate and expedite assembly of the two-part vent stop of the invention, the respective housing side walls 24, 25 are provided on inner surfaces thereof with two sets of opposed vertically disposed slots 60, 61 which are aligned vertically with the pivot openings 31, 32 and the detent openings 50 respectively. The width of the first pair of slots 60 is such as receive the pivot pins 33, 34 of the tumbler, while the width of the second pair of slots 61 is such as to receive the detent projections 47, 48. As shown in FIGS. 8 and 9, the vertical slots are inclined downward and inward and merge at their lower ends with the inner surfaces of the housing side walls. At their upper extremities the inclined slots 60, 61 extend into the flange 23 and have a maximum width, at the top, approximately equal to the end-to-end dimension of the pivot pins 33, 34 and the detent projections 47, 48. In the illustrated example, the slots 60, 61 are inclined at an angle of about 8° and merge with the inside side wall surfaces at a level slightly below the upper extremities of the respective pivot openings 31, 32 and detent openings 50, as can be seen in FIGS. 8 and 9.

In accordance with an aspect of the invention, a tumbler 22 and housing 20 are assembled by inserting a tumbler part way into the housing cavity 21, with the pivot pins 33, 34 and the detent projections 47, 48 aligned with the slots 60, 61. The tumbler is then pressed into to cavity, causing the pivot pins and detent projections to slide downward within the inclined slots. This causes the housing side walls to be progressively and resiliently displaced outwardly, until the pivot pins and detent projections are aligned with their respective openings 31, 32 and 50, at which time the housing side walls return to their normal configuration, engaging and permanently retaining the tumbler in operative relation within the housing.

In order to actuate the tumbler 22 from a recessed position (FIG. 1) to an extended position (FIG. 2) the exposed upper surface 62, at the short end of the tumbler is depressed with a finger or thumb a sufficient distance to cause the detent projections 47, 48 to pass through the restricted portions 53 of the detent openings 50. Once the detent projections pass through the restricted portions, the resilient action of the displaceable side wall portions 58, 59 will cause the tumbler to continue pivoting into its extended limit position. Preferably, the housing flange 23 is provided, at the end of the housing in which the short end 36 of the tumbler is positioned, with a U-shaped recess 63, which allows the tumbler surface 62 to be easily depressed sufficiently by the user's finger assure the full pivotal motion of the tumbler. Typically, a small recess 64 is provided in the upper edge of the tumbler in order to separate the pressing surface 62 from the exposed upper surface 65 of the long end 35 of the tumbler. This facilitates visually identifying the surface 62 to be pressed when actuating the tumbler.

Because of the multiple requirements of, and functions performed by the housing 20, it is preferably formed of an engineering plastic material having substantial strength and resiliency. A preferred material for this purpose is CELCON® acetal copolymer, available from Ticona, of Summit, N.J. A preferred material for the tumbler is nylon.

The invention represents a significant improvement in vent stop devices because it provides all of the necessary functions of such a device without compromise—indeed with certain improvements—yet is formed of only two parts. Prior art devices performing similar functions typically have required the provision and assembly of at least three individual parts. Because of the nature and utilization of vent stop devices, purchasers thereof (typically window manufacturers) are very price conscious. The device of the present invention, requiring only two parts and a minimal, easily automated assembly step, enables a significant reduction in the manufacturing cost of the device with no sacrifice of performance. Whereas heretofore, a separate spring element has been required to achieve the desired action of the tumbler, the device of the present invention derives the necessary spring action from the interaction of the housing and tumbler, and preferably by forming resiliently displaceable portions of the housing side walls, which control movements of the tumbler between its retracted and extended limit positions.

The vent stop device of the invention not only derives all the necessary functionality with a mechanism of only two parts, but additionally enables a fully functional device to be assembled by simply pressing one part together with the other.

It should be understood, of course, that the preferred embodiment of the invention herein illustrated and described is intended to be representative of the invention and it will be recognized by those skilled in the art that certain variations may be made therein without departing from the teachings of the disclosure. In this respect, although the described embodiment of the invention is indicated to have detent features in both side walls of the housing, it is acceptable in many cases if at least one side has a detent recess. Accordingly, reference should be made to the following appended claims in determining the full scope of the invention.

What is claimed is:

1. A motion-limiting device for installation in a window assembly, which comprises, a housing formed of a resilient plastic material and comprising spaced apart side walls, defining an internal cavity and said cavity having an opening at the top of said housing, said housing being configured for reception in a recess or opening in a window sash rail, a tumbler pivotally mounted within said housing cavity for limited pivotal movement about a pivot axis and having first and second pivot limit positions, said tumbler in said first limit position being recessed within said cavity and in said second limit position having a portion extending outward from said cavity, at least one of said housing side walls having a detent recess therein spaced in a radial direction from said pivot axis, a detent element fixed to and projecting laterally from said tumbler and having a portion received within said detent recess, said detent element being movable through an arcuate path upon pivoting movement of said tumbler, said detent recess defining first and second end portions accommodating a range of movement of said detent element and said tumbler with respect to said housing, said first and second end portions corresponding to said first and second limit positions of said tumbler, said at least one housing side wall having a resiliently displaceable region defining a restricted portion of said detent recess between said first and second end portions, said restricted portion being positioned to engage and restrict movement of said detent element and requiring the application of external force on said tumbler to enable said detent element to pass through said restricted portion, enabling said tumbler to pivot in either direction between its first and second limit positions.

2. A motion limiting device according to claim 1, wherein said resiliently displaceable region is displaceable in a plane defined by said at least one housing side wall.

3. A motion limiting device according to claim 2, wherein said detent recess comprises a through opening in said at least one housing side wall, said opening having a first end, a second end, and a restricted central portion, said detent element having a portion of predetermined width received in said detent recess, and the first and second ends of said recess being of widths to freely receive said detent element and the restricted central portion of said recess being of a width less than the width of said detent element, whereby movement of said detent element from one end to the other of said detent recess requires the application of force to cause displacement of said displaceable region and enable said detent element to pass through said restricted central portion.

4. A motion limiting device according to claim 3, wherein said at least one housing wall is formed with at least one secondary opening therein extending alongside said detent recess in generally parallel relation thereto, said secondary opening and said detent recess define between them a narrow, resiliently displaceable side wall portion having first and second end portions integrally joined with said at least one side wall and an intermediate portion forming part of the restricted central portion of said detent recess, and said intermediate portion of said side wall portion is resiliently displaceable by said detent element as said detent element is moved from one end to the other of said detent recess.

5. A motion limiting device according to claim 4, wherein recesses are provided in both side walls of said housing, and integral elements extend from opposite sides of said tumbler into said recesses, and at least one of said recesses comprises said detent recess and at least one of said integral elements comprises said detent element.

6. A motion limiting device according to claim 5, wherein secondary openings extend alongside each side of said detent recess in generally parallel relation thereto and defining narrow, resiliently displaceable side wall portions forming opposite side portions of said detent recess.

7. A motion limiting device according to claim 5, wherein said tumbler has integral, cylindrically shaped pivot pins projecting from opposite sides thereof on a common axis, said housing has pivot openings in opposite side walls thereof disposed on said pivot axis, said tumbler and said pivot pins having a combined width greater than a width of the internal cavity of said housing, and said housing side walls are formed on inner surfaces thereof with inwardly opening first vertical slots extending from upper edges of said side walls downward toward said pivot openings along a downwardly and inwardly inclined surface, whereby said pivot pins may be entered into upper portions of said first vertical slots and pressed downwardly therein, progressively displacing said housing side walls outwardly until said pivot pins are seated in said pivot openings.

8. A motion limiting device according to claim 7, wherein said tumbler has integral elements projecting from opposite sides thereof and spaced a distance radially from said pivot axis, and said integral elements extend into said recesses and are movable from one end to the other of said recesses when said tumbler is pivoted from one of its limit position to the other within said housing.

9. A motion limiting device according to claim 8, wherein said tumbler and said integral elements have a combined width greater than a width of the internal cavity of said housing, and said housing side walls are formed on inner surfaces thereof with inwardly opening second vertical slots extending from upper edges of said side walls downward toward said recesses along a downwardly and inwardly inclined surface, whereby said integral elements may be entered into upper portions of said second vertical slots and pressed downwardly therein, progressively displacing said housing side walls outwardly until said integral elements are seated in said recesses.

10. A motion limiting device according to claim 5, wherein said first and second ends of said detent recess are of circular cross section and of a diameter to receive said detent element, and the circular cross section of said first end intersects with the circular cross section of said second end to form the restricted central portion of said detent recess.

11. A motion limiting device according to claim 10, wherein said detent element comprises a cylindrical element of circular cross section, a diameter of said detent element is equal to or less than the diameter of the ends of said detent recess, and a width of said restricted central portion is less than the diameter of said detent element.

12. A motion limiting device according to claim 11, wherein centers of the respective circular first and second ends of said detent recess are equidistant from said pivot axis, and secondary openings extend alongside each side of said detent recess in generally parallel relation thereto and define resiliently displaceable side wall portions forming opposite side portions of said detent recess.

13. A motion limiting device according to claim 12, wherein one side portion of said detent recess, in the restricted central portion thereof, has a smoother contour than the other side portion, whereby said restricted central portion has an asymmetrical configuration.

14. A motion limiting device according to claim 13, wherein said one side portion having a smoother contour is the side portion spaced farthest from said pivot axis.

15. A two-part motion limiting device for installation in a window assembly, which device consists of a housing molded of a resilient plastic material and comprising spaced apart side walls, defining an internal cavity and said cavity having an opening at the top of said housing, said housing being configured for reception in a recess or opening in a window sash rail, and a tumbler pivotally mounted within said internal cavity for limited pivotal movement about a pivot axis and having first and second pivot limit positions, said tumbler in said first limit position being recessed within said cavity and in said second limit position having a portion extending outward from said cavity, said tumbler being molded of a plastic material and having integral, cylindrically shaped pivot pins projecting from opposite sides thereof on a common axis, said housing side walls having pivot openings therein located on a predetermined pivot axis and being of a size to closely receive said pivot pins for pivotally mounting said tumbler in said housing, said tumbler and said pivot pins having a combined width greater than a width of the internal cavity of said housing, said housing side walls being formed on inner surfaces thereof with inwardly opening first vertical slots extending from upper edges of said side walls downward toward said pivot openings along a downwardly and inwardly inclined surface, whereby said pivot pins may be entered into upper portions of said first vertical slots and pressed downwardly therein, progressively displacing said housing side walls outwardly until said pivot pins are seated in said pivot openings, integrally molded elements of said tumbler and integrally molded elements of said housing cooperating to form said first and said second limit positions of said tumbler, said housing and said tumbler having respective integrally molded detent elements, at least one of which is resiliently deflectable by the other during pivotal movement of said tumbler from one limit position to the other limit position, whereby said tumbler, when moved to a limit position, is resiliently retained in such limit position.

16. A two-part motion limiting device according to claim 15, wherein the integrally molded detent elements comprise a tumbler detent element projecting from a surface of said tumbler toward a housing detent element on a wall of said housing, said housing detent element being temporarily resiliently deflectable by said tumbler detent element during pivotal movement of said tumbler from one limit position to the other limit position thereof and operable to resiliently retain said tumbler in said other limit position.

17. A two-part motion limiting device according to claim 16, wherein said tumbler detent element comprises at least one of a pair of integral projections extending laterally from opposite sides of said tumbler, said housing comprises second openings in each of said housing side walls spaced radially from said pivot axis and positioned to receive said integral projections, said second openings having a length and configuration to accommodate arcuate movement of said integral projections during pivotal movements of said tumbler between said limit positions, said second openings having first and second ends, receiving said integral projections when said tumbler is in said limit positions, and at least one of said second openings is a detent opening which receives said tumbler detent element and has resilient portions of restricted width between said first and second ends forming said housing detent element, said resilient portions of restricted width being of a narrower width than said tumbler detent element, whereby said resilient portions must be resiliently displaced to enable said tumbler detent element to move from one end to the other of said at least one of said second openings.

18. A two-part motion limiting device according to claim 17, wherein a secondary opening is formed in at least one of said housing side walls spaced a short distance from and extending alongside at least one side of said detent opening, said secondary opening and said detent opening define between them narrow, resiliently displaceable side wall portions having first and second end portions integrally joined with said at least one of said housing side walls and intermediate portions forming said resilient portions of restricted width, and said intermediate portions are temporarily resiliently displaced by movement of said tumbler detent element from one end to the other of said detent opening.

19. A motion limiting device according to claim 18, wherein said tumbler and said integral projections have a combined width greater than a width of the internal cavity of said housing, and said housing side walls are formed on inner surfaces thereof with inwardly opening second vertical slots extending from upper edges of said side walls downward toward said second openings along a downwardly and inwardly inclined surface, whereby said integral projections may be entered into upper portions of said second vertical slots and pressed downwardly therein, progressively displacing said housing side walls outwardly until said integral projections are seated in said second openings.

20. A motion limiting device according to claim 18, wherein secondary openings are formed in said at least one of said housing side walls spaced a short distance from and extending alongside opposite both sides of said detent opening, said secondary openings and said detent opening define between them narrow, resiliently displaceable side wall portions on each side of said detent opening, each of said narrow, resiliently displaceable side wall portions having first and second end portions integrally joined with said at least one of said side walls and intermediate portions forming said resilient portions of restricted width, said narrow, resiliently displaceable side wall portions defining side portions of said detent opening, and the intermediate portions on both sides of said detent opening are temporarily resiliently displaced by movement of said tumbler detent element from one end to the other of said detent opening.

21. A motion limiting device according to claim 20, wherein said tumbler detent element is of cylindrical form and of circular cross section of predetermined diameter, the respective end portions of said detent opening are of circular form and of a diameter to closely receive said tumbler detent element, and intermediate portions of said detent opening define a portion of restricted width narrower than said predetermined diameter.

22. A motion limiting device according to claim 21, wherein the narrow, resiliently displaceable side wall portions on the side of said detent opening closer to said pivot axis having central portions projecting into said detent opening at first distance to restrict the width of intermediate portions of said detent opening, and the narrow, resiliently displaceable side wall portions on the sides of said detent opening farther from said pivot axis having central portions projecting into said detent opening a second distance less than said first distance.

23. A motion limiting device according to claim 17, wherein both of said pair of integral projections are tumbler detent elements, the second openings in each of said side walls are detent openings, each of which receives one of said tumbler detent elements and has portions of restricted width narrower than the tumbler detent elements received therein.

24. A motion limiting device according to claim 15, wherein said tumbler has a first end and a second end on opposite sides of said pivot axis, the first end of said tumbler being projected from said housing when said tumbler is pivoted to said second limit position, the second end of said tumbler being displaced into said housing cavity when said tumbler is pivoted to said second limit position, said housing has a bottom wall joining lower edges of said side walls and end walls joining opposite end edges of said side walls, said second end of the tumbler has lower surfaces engageable with bottom wall surfaces of said housing to support said tumbler in said second limit position against rotational forces applied to the projected first end of said tumbler tending to rotate said tumbler beyond said second limit position, and said second end of the tumbler has an end surface portion engageable with a surface portion of an adjacent housing end wall, when said tumbler is in said second limit position, to support said tumbler against linear forces applied to the projected first end of said tumbler.

25. A motion limiting device according to claim 24, wherein a portion of said housing bottom wall, adjacent the second end of said tumbler, is elevated with respect to other portions of said bottom wall for supporting engagement with the second end of said tumbler when said tumbler is in said second limit position.

26. A motion limiting device according to claim 25, wherein said elevated bottom wall portion is contoured to form an internally elevated portion and a recess adjacent to said elevated portion on the side thereof spaced farther away from said pivot axis, said elevated portion and said recess engaging and supporting respective recessed and projecting portions of the second end of said tumbler.

* * * * *